United States Patent [19]

Graham

[11] Patent Number: 4,798,143

[45] Date of Patent: Jan. 17, 1989

[54] GAS DISPENSING PROJECTILE

[76] Inventor: Douglas Graham, Box 478, Riyadh, Saudi Arabia

[21] Appl. No.: 46,921

[22] Filed: May 6, 1987

[51] Int. Cl.[4] ..... F42B 13/32; F42B 13/46

[52] U.S. Cl. ..... 102/370; 102/400

[58] Field of Search ..... 102/400, 370, 519, 502, 102/510, 512, 507, 517, 369

[56] References Cited

U.S. PATENT DOCUMENTS

| | | | |
|---|---|---|---|
| 674,509 | 5/1901 | MacMartin | 102/400 |
| 1,131,761 | 3/1915 | Wheaton | 102/370 X |
| 1,139,354 | 5/1915 | Featherstone-Smith et al. | 102/400 |
| 1,277,023 | 8/1918 | Alexander | 102/400 |
| 1,417,475 | 5/1922 | Weeke | 102/370 |
| 2,096,698 | 10/1937 | Lowy et al. | 102/370 |
| 2,920,566 | 1/1960 | Barker | 102/370 |
| 3,102,607 | 9/1963 | Roberts | 244/118.5 |
| 3,859,598 | 1/1975 | McElwain et al. | 102/400 |
| 3,867,244 | 2/1975 | Adams | 236/44 |
| 4,022,404 | 5/1977 | Greiss | 244/118.5 |
| 4,050,208 | 9/1977 | Pompei et al. | 244/119 |
| 4,055,317 | 10/1977 | Greiss | 244/118.5 |
| 4,121,790 | 10/1978 | Graham | 244/118.5 |
| 4,291,851 | 9/1981 | Johnson | 244/119 |
| 4,479,621 | 10/1984 | Bergholz | 244/117 R |
| 4,552,325 | 11/1985 | Bruensicke | 244/118.5 |

FOREIGN PATENT DOCUMENTS

| | | | |
|---|---|---|---|
| 275775 | 6/1914 | Fed. Rep. of Germany | 102/400 |

*Primary Examiner*—David H. Brown

*Attorney, Agent, or Firm*—Lowe, Price, LeBlanc, Becker & Shur

[57] ABSTRACT

A warhead adapted to be mounted to a conventional missile fired from anti-tank weaponry is formed with a piercing cone secured to a base containing a source of knockout gas and an actuator assembly. Upon piercing an aircraft fuselage, a collar encircling the cone translates rearwardly causing deployment of panels pivotally secured to the base portion and connected to the collar via connecting rods. Movement of the collar into wedging contact with the base of the piercing cone deploys the panels to their maximum extended position and simultaneously actuates the trigger assembly causing the knockout gas to be delivered into the aircraft interior through the piercing cone projecting through the fuselage into the interior.

28 Claims, 3 Drawing Sheets

GAS DISPENSING PROJECTILE

TECHNICAL FIELD

The present invention relates to projectiles for dispensing knockout gas, powder, and the like in counter terrorist hostage recovery situations from aircraft and other vehicles and, more particularly, to a gas dispensing warhead or projectile that may be launched from conventional anti-tank weaponry and which pierces the aircraft vehicle fuselage to dispense knockout gas into the aircraft vehicle interior while remaining embedded within the fuselage wall.

BACKGROUND ART

Within the past decade there have been numerous instances of hijacking of commercial aircraft by terrorists in which the passengers are held hostage within the aircraft for political and economically motivated purposes. To attempt overpowering the hijackers while the aircraft is on the ground (e.g., during refueling) assault teams are sometimes employed which attempt to board the aircraft to overcome the hijackers with deadly force and with minimum casualities among the hostages. To accomplish this, an assault team must neutralize (i.e., render unconscious or powerless) the terrorists in an almost instantaneous manner to prevent immediate retaliation against the hostage passengers.

The use of a knockout gas administered to the aircraft interior, if successfully accomplished, may neutralize the terrorists with minimal harm to the hostages. However, the use of a knockout gas against terrorists has traditionally been frustrated for two reasons. First, gas delivery systems of which I am aware generally comprise inaccurate canister systems which must be delivered through an open door of the aircraft. In most hostage situations, since only one entrance door is usually open, and even if the assault team is successful in placing a canister of gas within the opening, the gas usually cannot spread through the entire aircraft interior quickly enough to neutralize all the terrorists especially when the terrorists are uniformly distributed throughout the aircraft interior.

It is accordingly one object of the present invention to provide a gas dispensing warhead which may be mounted on extremely accurate and conventional wire guided anti-tank weaponry so that one or more gunners firing one or more warheads can hit the aircraft target at specific points and with great accuracy to quickly dispense a knockout gas throughout the entire aircraft interior.

Another object of the invention is to provide a gas dispensing warhead that may be mounted to a standard anti-tank missile as the delivery means so that either minimal or no additional training is necessary to train assault teams in the proper use of the weapon system.

Another object of the invention is to provide a gas dispensing projectile or warhead that may be fired from remote relocations (e.g., about one kilometer) and which gas dispensing projectile or warhead will pierce the aircraft fuselage causing knockout gas to be released into the aircraft interior, while the projectile itself remains safely anchored within the fuselage wall so that it does not collide with hostages.

Yet a further object is to provide a gas dispensing warhead for use with conventional anti-tank weaponry systems whereby a plurality of gas dispensing warheads may be simultaneously fired to penetrate different sections of the aircraft fuselage enabling uniform distribution of knockout gas throughout the aircraft interior.

DISCLOSURE OF THE INVENTION

A knockout gas dispensing projectile, in accordance with the present invention, comprising a piercing cone being a generally hollow structure formed with at least one opening in a side wall thereof. The piercing cone is connected to a base portion containing a knockout gas supply means, and actuating means responsive to abrupt lodgement of the projectile within a material pierced by the piercing cone for releasing knockout gas from the supply and enabling the gas to flow through the piercing cone and outwardly therefrom through said at least one opening. Stop means are pivotally secured to the piercing cone for deployment, in response to entry of the piercing cone into the material, from a retracted position wherein the stops extend generally along the piercing cone to an extended position wherein the stops pivot outwardly from the piercing cone into a maximum diameter position to thereby cause the abrupt lodgement of the projectile in the material and induce actuation of the actuator, releasing the gas supply through the piercing cone.

More specifically, the projectile preferably includes a collar encircling the exterior of the piercing cone and which is movable along the piercing cone. The stop members, preferably in the form of deployment panels advantageously defining the projectile casing, are pivotally secured to the base and connected to the collar for deployment in response to movement of the collar along the piercing cone.

The collar is preferably in the form of an annular member having an inner diameter sufficient to enable it to translate along the piercing cone from the forward end to contact the rear end adjacent the base portion. The plural deployment panels are hinged at a rear end thereof to the base portion and extend forwardly along the piercing cone. The deployment panels are preferably each connected to the collar with at least one connecting rod having one end pivotally secured to the collar and another end pivotally secured to the associated deployment panel. The connecting rod is pivotally secured to the inner surface of the associated panel with a hinge formed intermediate opposite ends of the panel. If desired, one or both ends of each connecting rod may be secured to the associated hinge through a shock absorber.

The deployment panels, in their retracted position, extend generally parallel to a longitudinal axis of the projectile which is a trajectory axis during flight. Furthermore, the deployment panels, in their retracted position and in coaction with the connecting rods, serve to maintain the collar in a concentrically mounted location proximate but rearwardly spaced from the forward end of the piercing cone and spaced out of initial contact with the piercing cone. As best understood, the unique manner in which the collar is suspended in 'floating position' relative to the piercing cone enables the collar to engage a surface being penetrated which surface may be obliquely formed relative to the trajectory axis and to thereby ensure that the collar travels along the piercing cone without effecting a premature wedging contact thereagainst which may prevent deployment of the panels.

In accordance with a preferred feature of the invention, a nose cone is connected to project forwardly from the deployment panel. The nose cone may include a base edge connected in contact with forward edges of the deployment panels. The nose cone is preferably formed of a substance which deforms upon impact with the material being pierced to enable the piercing cone to pierce the material in a manner generally unobstructed by the nose cone.

In one aspect of the invention, the nose cone may be formed of a substance and in such a manner as to transmit the force of impact along the nose cone to the forward edges of the deployment panels, thereby enabling initial pivoting movement of the deployment panels to their extended position as a result of the forced transmission.

The nose cone is preferably a generally hollow member the front end of which is spaced forwardly from the front end of the piercing cone. The base edge of the nose cone may be formed with a stepped portion receiving the forward edges of the deployment panels with said forward edges being positioned radially outward from the stepped portion and generally coplanar with a side wall of the nose cone projecting forwardly therefrom. This nesting arrangement tends to assure that the deployment panels deflect outwardly from the piercing cone upon initial contact between the nose cone with the material being pierced.

The nose cone is preferably designed to shatter upon impact with the material being pierced. In one embodiment, the nose cone is generally transparent to enable visual inspection of interior regions of the projectile. The nose cone may be plastic while the piercing cone is metal, such as hardened steel or the like.

The nose cone may also be designed with a side wall that is thicker at the front end of the nose cone and formed with longitudinal score lines being respectively generally coplanar with longitudinal side edges of the deployment panels. Impact with the material causes the nose cone to initially shatter along the score lines at the base edges first to exert a radially outward force against the panels to initiate the deployment thereof.

In a further embodiment of the invention, the deployment panels may be formed as an assembly of diametrically opposed pairs of panels.

In accordance with another feature of the invention, the deployment panels are curved members subtending the base for circumferential intervals to substantially entirely enclose the piercing cone in cooperation with the nose cone. Adjoining longitudinal side edges of the deployment panels are thereby substantially in contact with each other when in the retracted position. The adjoining edges of the panels may be lapped and may further include sealing means therebetween for preventing entry of moisture into the projectile. Thusly formed, the panels define the projectile casing which is generally cylindrical to endure minimal change in flight.

Arrestor cables may be provided connected to each of the deployment panels to further ensure that the panels remain in their maximum diameter position to ensure lodgement of the projectile in the material.

The novel features which are characteristic of the present invention, and other objects and advantages thereof, will be better understood from the following detailed description and the accompanying drawings which together disclose the presently preferred embodiment of the invention.

BEST MODE FOR CARRYING OUT THE INVENTION

Figure 1:
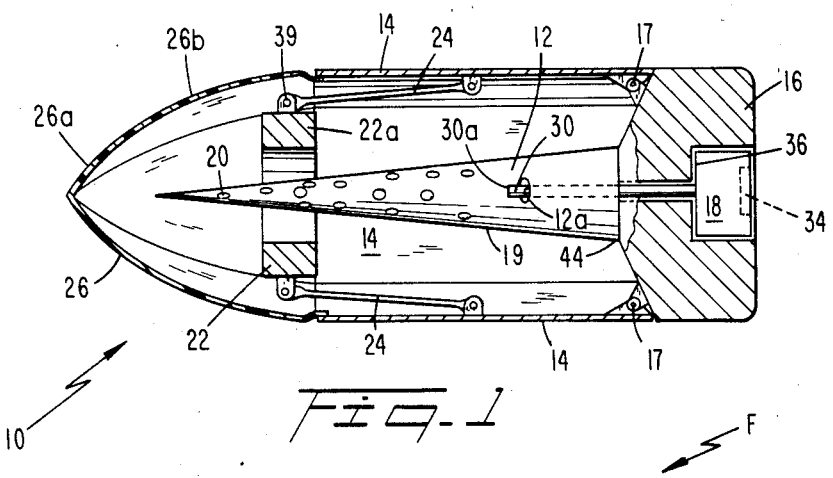
FIG. 1 is a cross-sectional view of a gas dispensing projectile according to the present invention.
Figure 3:
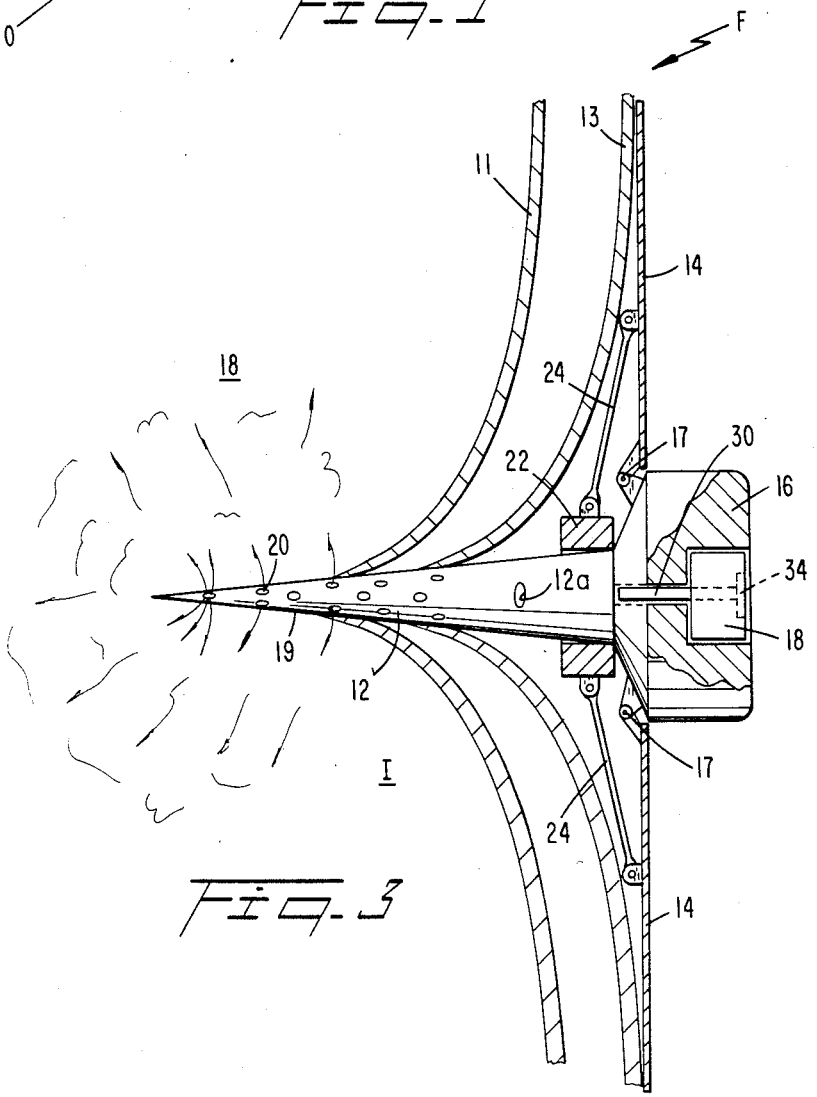
FIG. 3 is a partial sectional view depicting the projectile of the present invention lodged within the fuselage of an aircraft.
Figure 2:
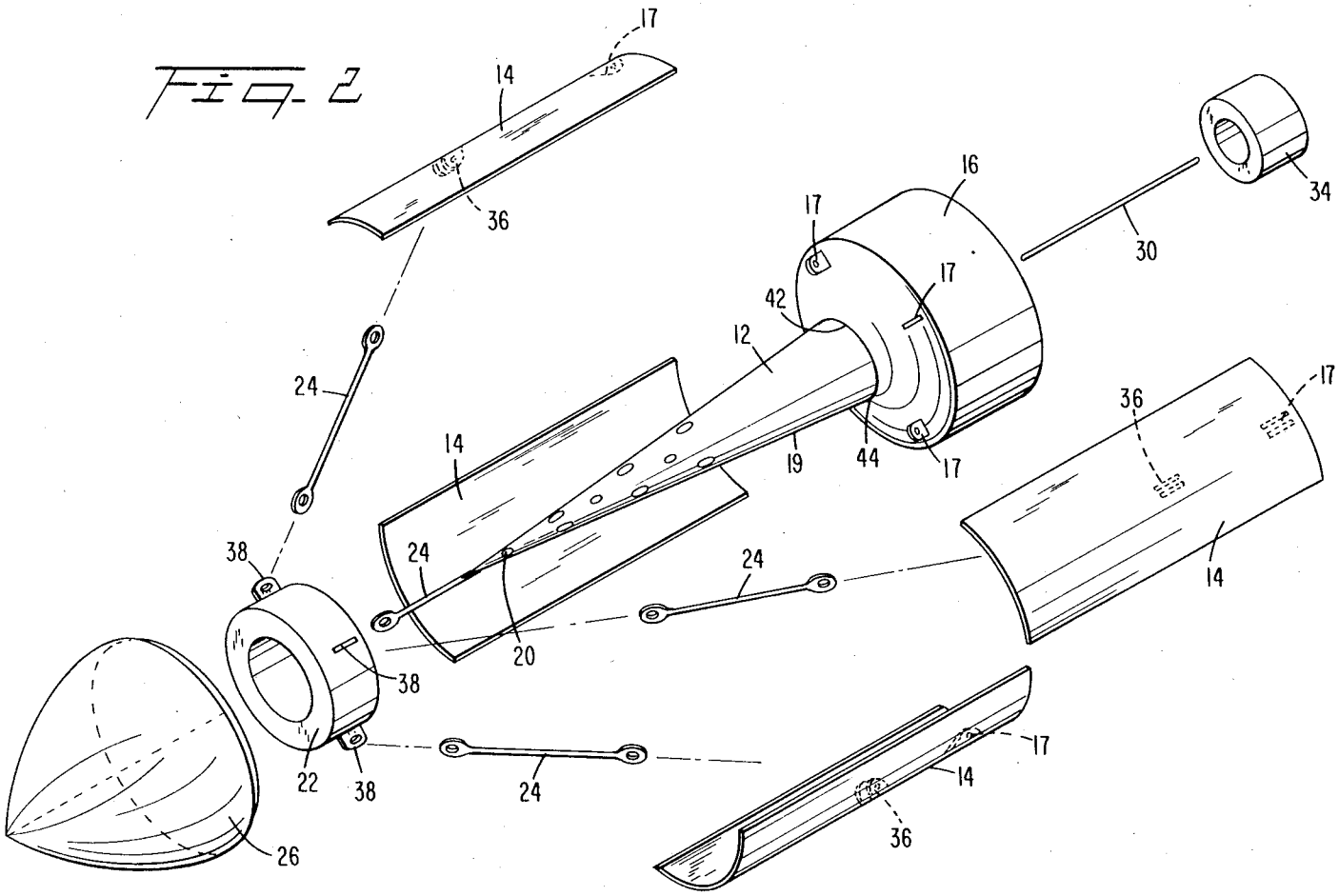
FIG. 2 is an exploded perspective view of the projectile of the invention depicting various parts thereof of the preferred embodiment.

Referring to FIGS. 1–3, a gas dispensing projectile 10 according to the present invention comprises a piercing cone (e.g. hardened steel) 12 designed to pierce through the inner and outer skins 11 and 12 of an aircraft fuselage F with the forward end of the piercing cone disposed within the aircraft interior I such as a passenger compartment. The piercing cone 12 remains lodged within the fuselage shell by means of unique deployment panels 14 (which may define sides establishing a casing of projectile 10 in their retracted position shown in FIG. 1). Deployment panels 14 are pivotally secured at their rear ends to a base unit 16 with hinges 17. The base unit 16 contains a supply of knockout gas or powder 18. Furthermore, as will be seen more fully below, the interior of base unit 16 is in communication with the interior of the generally hollow piercing cone 12 having a side wall 19 provided with at least one opening 20 in the forward end thereof through which knockout gas may be released in the aircraft interior.

The panels 14 are uniquely deployed into their extended position of FIG. 3 by means of a collar 22 connected to the deployment panels with connecting rods 24. Each connecting rod 24 is pivotally secured to collar 22 and its associated panels 14. In the retracted position of panels 14 (e.g., FIG. 1) wherein the panels extend generally parallel to the longitudinal axis of piercing cone 12, the collar 22 is positioned concentrically about the forward portion of piercing cone 12. Upon impacting against the outer skin 13 of the aircraft fuselage F, a frangible nose cone 26 (enclosing the forward end of piercing cone 12) shatters to enable the forward end of the piercing cone to penetrate the inner and outer skins of the fuselage shell. As further penetration of piercing cone occurs, the front end of collar 22 contacts the outer skin 13 of the aircraft and is thereby caused to move along the piercing cone 12 towards base unit 16. Translation of the collar 22 in this manner causes deployment panels 14 to pivot outwardly via connecting rods 24. The connecting rods 24 are configured to deploy the panels 14 into their maximum diameter position of FIG. 3 as the rear end of the collar contacts the forward end of the base unit 16. The deployment panels 14 thus act to prevent the projectile 10 and piercing cone 12 from penetrating fully into the aircraft interior.

As the ram collar 22 approaches the front end of base unit 16, its rear surface **22*a* engages the front end 30*a* of an actuating rod 30** projecting forwardly through the front end wall of the base unit and through an opening 12*a* in cone 12. As the ram collar 22 contacts the front end 30*a* of the rod 30, movement of the rod into the base unit causes the rod to actuate a primer (schematically shown at 34) which operates to explosively propel the knockout gas or powder within the base unit through the interior of piercing cone 12 and outwardly through openings 20 into the aircraft interior.

Initially, the interior of the piercing cone may be separated from the interior of the base unit 16 by a frangible seal 36 which seal will rupture under the detonating force of the primer 34 or by penetration of the seal 36 by rod 30.

Projectile 10 of the present invention, as will occur to those skilled in the art, may be mounted as a warhead on extremely accurate wire guided anti-tank weapons (such as the Dragon or M-47 Medium Anti-Tank Weapon) or standard anti-tank missiles may be used as the delivery system so that minimal additional training of assault teams in the use of projectile 10 will be necessary. Also, the base unit 16 of projectile 10 may be mounted within a propelling base which, in some situations, may be used to fire projectile 10 from mortar and other types of light artillery weapon systems.

It will also occur to those skilled in the art, based upon a review of the present disclosure, that other types of impact fuses may be provided to cause explosive detonation within the base unit 16 to release the knockout gas or powder 18 into the aircraft interior. Other types of fuses may also be employed. It may also be possible to employ proximity fuses and other types of actuators as will now occur to those skilled in the art upon examination of the present disclosure.

Figure 5:
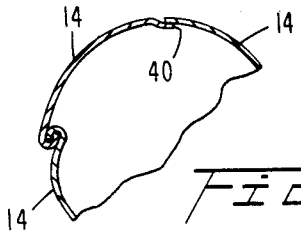
FIG. 5 is a cross-sectional view of a pair of deployment panels in their retracted position.

The deployment panels 14 preferably define the sides (i.e., casing) of projectile 10 and are therefore formed as curved panel members subtending the base unit 16 for angular intervals determined by the formula 360°/n, wherein n equals the number of panels. With reference to FIGS. 2 and 5, each panel 14 may be formed with a central loop (which may be formed by stamping) 36 along the interior surface thereof which may receive the rear end of the associated connecting rod 24 pivotally secured thereto with pin 38. The collar 22, as shown in FIG. 2, may be formed with a hinge portion 38 receiving the forward end of the associated connecting rod 24 pivotally secured thereto with pin 39. The rear edge of each panel 14 may also be formed with an interior hinge adjacent the rear edge or inner surface for pinned connection to base unit 16 as shown in FIG. 2.

If preferred, and with reference to FIG. 5, adjoining longitudinal side edges 40 of the deployment panels 14 may be bent into cross-sectional U-shape (FIG. 5 only) so that they sealingly lap with each other to prevent entry of moisture into the projectile 10 and to assist in maintaining the structural integrity of the projectile 10 prior to impact. Alternatively, or in conjunction therewith, it is possible to form the deployment panels 14 without shaping the edges 40 in the above manner and to secure the panels 14 in the retracted or undeployed position of FIG. 1 by means of bands (not shown in detail) encircling the outer periphery of the projectile 10.

With reference to FIG. 1, an important preferred feature of the present invention is the manner in which ram collar 22 is suspended in 'floating position' concentrically about the forward end of piercing cone 12, by virtue of connecting rods 24. Since the inner diameter of collar 22 is greater than the outer diameter of the forward end of piercing cone 12, it is virtually assured that the collar 22 may uninterruptedly translate along the piercing cone 12 to deploy the panels 14 without become 'hung-up' on the piercing cone. Furthermore, by virtue of the floating condition of the ram collar 22, the projectile 10 advantageously may impact against a surface (e.g., the outer skin 13 of an aircraft fuselage) which is non-orthogonal to the longitudinal or trajectory axis of the projectile (i.e., non-parallel to the front surface of the ram collar), whereby the ram collar remains capable of translating along the piercing cone to commence deployment of the panels 14.

As a result of the present disclosure, numerous variations in the construction of projectile 10 will now occur to those skilled in the art. For example, since it is an important feature of the present invention to maintain the piercing cone 12 lodged within the aircraft fuselage by means of deployment panels 14 in their extended position, it may be desirable to design the ram collar 22 with an inner diameter that is slightly less than the outer diameter of the base portion 44 of the piercing cone 12. Thus, as the ram collar 22 translates from its initial position about the foward end of the piercing cone 12, it may contact the base portion 44 to effect a wedging action therewith just prior to full deployment of the panels 14. In this manner, this wedging contact effects a braking action of the deployment panels to prevent the panels from being snapped off the base unit 16.

Nose cone 26, as mentioned briefly above, is preferably a frangible material (e.g., plastic) designed to shatter upon impact with fuselage F so as to enable the piercing cone 12 to penetrate the fuselage in an uninterrupted manner. The nose cone 26 may be transparent to facilitate visual inspection of interior regions of projectile 10.

Figure 4A:
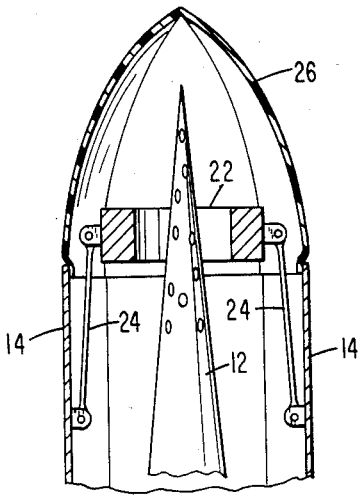
FIGS. 4A, 4B and 4C are illustrations of various structural features of the nose cones utilized in the present invention.
Figure 4B:
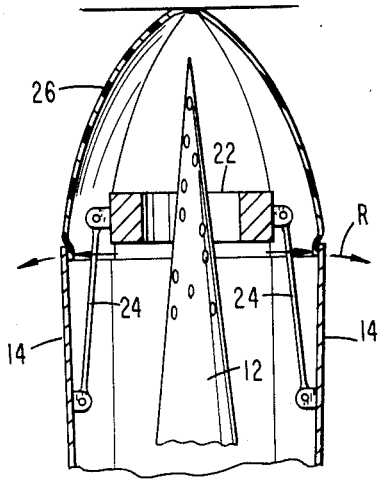
Figure 4C:
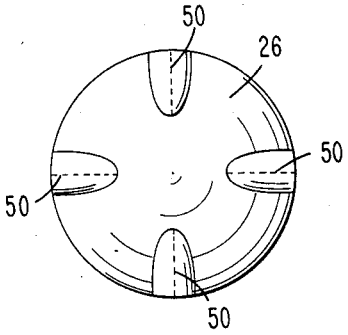

With reference to FIGS. 4A–4C, the base edge of nose cone 26 is preferably constructed as a stepped portion so as to receive the forward edges of deployment panels 14. Since the panels 14 and their forward edges are radially outward (FIG. 1) from the innermost stepped portion, initial contact of the nose cone 26 with the fuselage causes the base edge of the nose cone to shatter in a radially outward direction thereby transmitting a force causing the leading or forward edges of the deployment panels 14 to displace radially outwardly in the direction of deployment.

Nose cone 26 may be formed thicker at the front end 26*a* thereof than the base portions 26*b* to resist initial shattering of the front end. In addition, and preferably, the nose cone 26 is formed with perforated score lines 50 which are coplanar with the side edges of the deployment panels to initiate fracture of the nose cone along the score lines. By forming the base portions 26*b* of the nose cone thinner than the front end 26*a*, as discussed supra, and in combination with the fracture lines 50, initial shattering thus occurs at the base portions of the nose cone so that a transmissive force is exerted against the deployment panels 14 in a radially outward direction R (Figure 4B).

Figure 6:
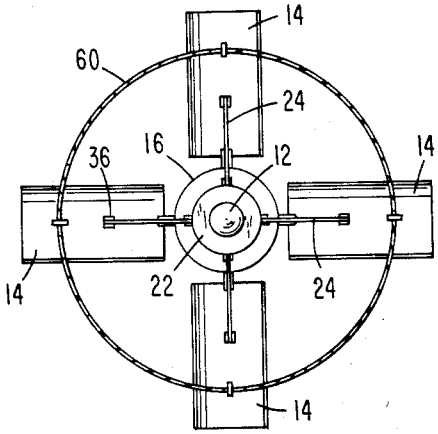
FIG. 6 is a perspective view of a second embodiment of the present invention.

To improve the structural integrity of deployment panels 14 an arresting cable 60 is provided as shown in FIG. 6 which is connected to an interior surface of each deployment panel and is stretched more or less taut when the panels are in the extended position. The arresting cable 60 tends to maintain the panels coplanar with each other in the extended, deployed position of FIG. 6.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A gas dispensing projectile, comprising:

(a) a piercing cone being a generally hollow structure formed with at least one opening in a side wall thereof;

(b) collar means encircling the piercing cone and being movable longitudinally along the piercing cone;

(c) base means connected to the piercing cone for containing a knockout gas supply means, and actuating means responsive to abrupt lodgment of said projectile within a material pierced by said piercing cone for releasing knockout gas from the supply means and enabling the gas to flow through the piercing cone and outwardly therefrom through said at least one opening; and (d) stop means pivotally secured to the base means and connected to the collar means for deployment, in response to movement of the collar means along the piercing cone, from a retracted position wherein the stop means extend generally along the piercing cone to an extended position wherein the stop means pivots outwardly from the base means into a maximum diameter position to thereby cause said abrupt lodgement of the projectile in said material and actuation of said actuating means.

2. The projectile of claim 1, wherein said collar means is an annular member having an inner diameter sufficient to enable the collar means to translate along the piercing cone.

3. The projectile of claim 1, wherein said piercing cone is formed with a plurality of said at least one opening substantially along its entire length.

4. The projectile of claim 1, wherein said stop means includes a plurality of deployment panels each hinged at a rear end thereof to the base means and extending forwardly therefrom along the piercing cone.

5. The projectile of claim 4, wherein substantially each said deployment panel is connected to said collar means with a connecting rod having one end pivotally secured to the collar means and another end pivotally secured to the associated deployment panel.

6. The projectile of claim 5, wherein said another end is pivotally secured to the inner surface of the associated panel with hinge means formed intermediate opposite ends of said panel.

7. The projectile of claim 5, wherein said deployment panels are formed as an assembly of diametrically opposed pairs of panels.

8. The projectile of claim 5, further including cable means connecting panels to each other for improving the structural integrity of the deployment panels in their extended position.

9. The projectile of claim 5, wherein said deployment panels are curved members subtending the base means for circumferential intervals to substantially entirely enclose the piercing cone in cooperation with a nose cone means, adjoining longitudinal side edges of said panels thereby substantially contacting each other when in the retracted position.

10. The projectile of claim 9 wherein said adjoining edges are lapped and include sealing means therebetween for preventing entry of moisture.

11. The projectile of claim 5, wherein said deployment panels, in their retracted position, extend generally parallel to a longitudinal axis of said projectile which is a trajectory axis of said projectile during flight.

12. The projectile of claim 11, wherein said deployment panels, in their retracted position and in coaction with said connecting rods, maintain the collar means in a concentrically mounted location proximate but rearwardly spaced from the forward end of the piercing cone and spaced out of initial contact with said piercing cone.

13. The projectile of claim 11, further comprising nose cone means connected to project forwardly from the deployment panels.

14. The projectile of claim 13, wherein said nose cone means includes a base edge connected in contact with forward edges of said deployment panels, the nose cone means being formed of a substance which deforms upon impact with said material being pierced to enable the piercing cone to pierce said material in a generally unobstructed manner.

15. The projectile of claim 14, wherein said substance transmits the force of impact along the nose cone means to said forward edges of the deployment panels to thereby enable initial pivoting movement of the deployment panels to their extended position.

16. The projectile of claim 14, wherein said nose cone means is a generally hollow member, the front end of which is spaced forwardly from the front end of the piercing cone.

17. The projectile of claim 16, wherein the base edge is formed with a stepped portion receiving the forward edges of the deployment panels, said forward edge being positioned radially outward from the stepped portion and generally coplanar with a side wall of the nose cone projecting forwardly therefrom.

18. The projectile of claim 13, wherein said substance forming the nose cone is designed to shatter upon impact with the material.

19. The projectile of claim 18, wherein said nose cone is thicker at the front end thereof and formed with longitudinal score lines being respectively generally coplanar with the longitudinal side edges of the deployment panels, whereby impact with said material causes the nose cone to initially shatter along the score lines at the base edges to exert a radially outward force against the panels to initiate deployment thereof.

20. The projectile of claim 18 wherein said nose cone is plastic and said piercing cone is hardened steel or the like.

21. The projectile of claim 20, wherein said nose cone is generally transparent to enable visual inspection of interior areas of the projectile.

22. A knockout gas dispensing projectile, comprising piercing cone being a generally hollow structure formed with at least one opening in a side wall thereof and connected to a base portion containing a knockout gas supply means and actuating means responsive to abrupt lodgement of said projectile with any material being pierced by said piercing cone for releasing knockout gas from the supply means and enabling the gas to flow through the piercing cone and outwardly therefrom through said at least one opening; and stop means connected to the piercing cone for deployment, in response to movement of the piercing cone through said material, from a retracted position wherein the stop means extends generally along the piercing cone to an extended position wherein the stop means moves outwardly from the piercing cone into a maximum diameter position to thereby cause said abrupt lodgement of the projectile in said material and actuation of said actuating means.

23. The projectile of claim 22, wherein said stop means, in deployed position, is generally coplanar with the base portion.

24. A substance dispensing projectile, comprising a generally hollow piercing member formed with at least one opening in a wall thereof, said member including base means for containing a supply of said substance and actuating means responsive to piercing by said projectile of any material being pierced by said piercing member for releasing substance from the supply means and enabling the substance to flow through the piercing member and outwardly therefrom through said at least one opening; and stop means connected to the piercing member for deployment, in response to movement of the piercing member through said material, from a retracted position wherein the stop means extends generally along the piercing member to an extended position wherein the stop means moves outwardly from the piercing member into a maximum diameter position to thereby arrest and cause abrupt lodgement of the projectile in said material.

25. The projectile of claim 24, wherein said substance supply means is a knockout gas supply means.

26. The projectile of claim 24, wherein said stop means includes a plurality of panels pivotally secured at rear end portions thereof to said base means, said panels, in the retracted position, extending along the piercing member to define a projectile body.

27. The projectile of claim 26, further including cable means connecting the panels to each other for improving the structural integrity of the deployment panels in their extended position.

28. A projectile, comprising an elongate piercing member and stop means connected to the piercing member for deployment, in response to movement of the piercing member through a material being pierced, from a retracted position wherein the stop means extends generally along a longitudinal axis of the piercing member to an extended position wherein the stop means moves outwardly from the longitudinal axis into a maximum diameter position to arrest and cause abrupt lodgement of the projectile in said material, said stop means being a plurality of panels defining an outer casing establishing the projectile body.

* * * * *